US006945188B2

(12) United States Patent
Eck et al.

(10) Patent No.: US 6,945,188 B2
(45) Date of Patent: Sep. 20, 2005

(54) WATER SPORT TOWER AND TOP COMBINATION FOR WATERCRAFT AND METHOD

(75) Inventors: Richard E. Eck, Minneapolis, MN (US); Joseph Ellice, St-Lambert (CA)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/813,039

(22) Filed: Mar. 31, 2004

(65) Prior Publication Data

US 2004/0187764 A1 Sep. 30, 2004

Related U.S. Application Data

(60) Provisional application No. 60/458,367, filed on Mar. 31, 2003.

(51) Int. Cl.[7] ..... B63B 17/00
(52) U.S. Cl. ..... 114/361; 114/253
(58) Field of Search ..... 114/253, 361, 114/364

(56) References Cited

U.S. PATENT DOCUMENTS

| | | | | | |
|---|---|---|---|---|---|
| 5,520,139 | A | * | 5/1996 | King et al. | 114/361 |
| 5,979,350 | A | * | 11/1999 | Larson et al. | 114/253 |
| 6,209,477 | B1 | * | 4/2001 | Biedenweg | 114/361 |
| 6,439,150 | B1 | * | 8/2002 | Murphy et al. | 114/361 |
| 6,691,637 | B1 | * | 2/2004 | Smith et al. | 114/361 |
| 6,725,799 | B2 | * | 4/2004 | Tull | 114/361 |
| 6,792,888 | B1 | * | 9/2004 | Metcalf | 114/364 |

* cited by examiner

*Primary Examiner*—Lars A. Olson
(74) *Attorney, Agent, or Firm*—BRP Legal Services

(57) ABSTRACT

An apparatus for connecting a towline from a watercraft, comprising a support structure of inverted U-shaped configuration comprising a pair of side supports. An overhead structure extends at upper ends of the side supports. The overhead structure includes fore and aft substructures. The support structure is adapted to be releasably mounted to a watercraft. A towline connector is provided on the aft substructure of the overhead structure for receiving a fore end of a towline. A protective cover is attached to the fore and aft substructures of the overhead structure.

19 Claims, 11 Drawing Sheets

WATER SPORT TOWER AND TOP COMBINATION FOR WATERCRAFT AND METHOD

The present application claims priority to U.S. Provisional Application of Eck et al., Ser. No. 60/458,367, filed Mar. 31, 2003, the entirety of which is hereby incorporated into the present application by reference.

BACKGROUND OF THE INVENTION

1. Field of the Invention

The present invention generally relates to watercraft and, more particularly, to watercraft adapted to tow a performer using water sport implements.

2. Background Art

The popularity of water sports in the form of, for instance, wakeboarding, has increased in recent years. Wakeboarding is relatively similar to its parent water sport, waterskiing, in that a performer is towed by a watercraft to skim the surface of the water with a water sport implement, a wakeboard in this case. However, in wakeboarding, there is some emphasis on the aerial performance of the performer. In wakeboarding, the performer towed by a watercraft is looking for as large a wake as possible from the watercraft, as the wake is used to launch the performer into the air.

Watercraft have been adapted for the aerial characteristics of wakeboarding by providing a connection point for the towline at a relatively high elevation above the deck of the watercraft. This adaptation will increase the air time of the performer as well as his launching height, as the towline will not transmit a downward force, as would be the case if the connection point between watercraft and towline were directly on the deck. Rather, the towline transmits an upward force, thereby increasing the air time of the performer.

U.S. Pat. No. RE37,823, reissued on Sep. 3, 2002 to Larson et al., discloses a water sport tower providing an elevated connection point for the towline. The water sport tower disclosed therein has a pair of inverted U-shaped members, with free ends of each inverted U-shaped member being oppositely connected port and starboard of the watercraft. The inverted U-shaped members thus connected to the watercraft are interconnected so as to provide a structure that will remain stable irrespective of the forces exerted by the maneuvers of the performer being towed. As mentioned previously, the connection point between the towline and the wakeboard tower is elevated with respect to the deck of the watercraft so as to ease the launching of the performer into his aerial performance.

Water sport towers, such as that described in U.S. Pat. No. RE37,823, have been used as supports for tops. Such tops, also referred to as bimini tops, come in the form of soft panels stretched by a framing structure, the framing structure being releasably securable to the water sport tower by way of various fasteners. Amongst the various factors influencing the design of tops for water sport towers is the fact that the tops, and their framing structures, must not impede the towline pulling the performer. Thus far, the tops have been provided separately from the water sport towers, whereby they must be stored individually and thus represent a bulky nonoptimal solution. Moreover, as they must not impede the movement of the towline, the tops are relatively close to the passenger seating area of the watercraft, thus procuring a feeling of confinement.

SUMMARY OF INVENTION

Therefore, one aspect of embodiments of the present invention provides a water sport tower combined with a top.

An additional aspect of the present invention provides a water sport tower/top combination where the top can be moved between a retracted and a covering position.

A further aspect of the present invention provides a watercraft having a water sport tower/top combination.

Another aspect of the present invention provides a method for installing the top with respect to the water sport tower of the present invention.

Therefore, in accordance with the present invention, there is provided a water sport tower for connection to a watercraft. The tower comprises a support structure having an inverted generally U-shaped configuration. The support structure comprises a pair of side supports and an overhead structure extending between the side supports. The overhead structure comprises first and second substructures. A towline connector for receiving an end of a towline is provided on the first substructure. A protective cover extends between the first and second substructures.

Also in accordance with the present invention, there is provide a method for covering a passenger area of a watercraft having a water sport tower. The water sport tower has an inverted generally U-shaped configuration having a pair of side supports. An overhead structure extends at upper ends of the side supports and has a towline connector thereon adapted to receive an end of a towline. A structural member has a first end of a cover secured thereto. The method comprises the steps of i) positioning the structural member in a spaced and parallel position with respect to the overhead structure; ii) securing a second end of the cover to the overhead structure; and iii) tensioning the cover by biasing the structural member away from the overhead structure so as to at least partially cover a passenger area of the watercraft with the cover.

BRIEF DESCRIPTION OF THE DRAWINGS

Having thus generally described the nature of the invention, reference will now be made to the accompanying drawings, showing by way of illustration a preferred embodiment thereof and in which:

FIG. 6 is a perspective view of the retractable top detached from the retracted position with respect to the water sport tower;

DESCRIPTION OF THE PREFERRED EMBODIMENTS

Figure 1:
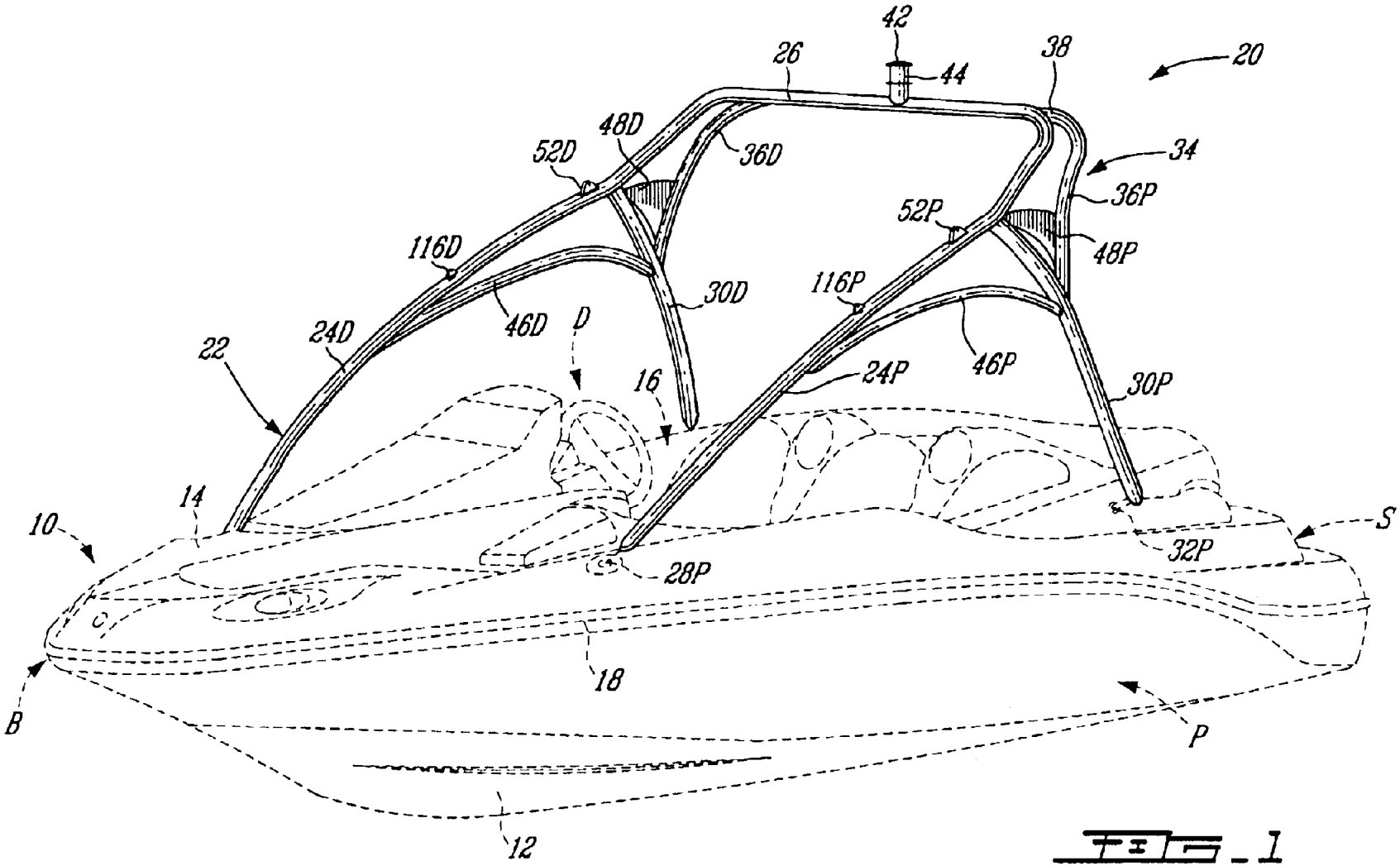
FIG. 1 is a perspective view of a watercraft supporting a water sport tower in accordance with the present invention.

Referring to the drawings, and more particularly to FIG. 1, a watercraft supporting a water sport tower in accordance with the present invention is generally shown at 10. The watercraft 10 includes a bow B, a stern S, a port P and a starboard D. The watercraft 10 has two main parts, namely hull 12 and deck 14. The hull 12 buoyantly supports the watercraft 10 in the water. The deck 14 has a recessed passenger area 16 designed to accommodate a driver and passengers. The hull 12 and the deck 14 meet at bond line 18. An engine (not shown) is disposed between the hull 12 and the deck 14. The engine is operatively coupled to a propulsion unit (not shown) to propel the watercraft 10.

A water sport tower in accordance with the present invention is generally shown at 20. The water sport tower 20 has a main frame member 22. The frame member 22 consists of a generally inverted U-shaped body, having a pair of legs 24 interconnected by horizontal member 26. It is pointed out that letters "D" and "P" will be affixed to like elements of the tower 20 in the figures, "D" and "P" respectively specifying whether the element is on the starboard side D or the port side. P of the watercraft 10. Connector portions 28 (only one of which is shown in FIG. 1) are provided at lower free ends of the legs 24, for releasable engagement with corresponding connector portions on the watercraft 10. The horizontal member 26 is transversely positioned with respect to a longitudinal axis of the watercraft 10, this longitudinal axis extending from bow B to stern S.

Figure 2:
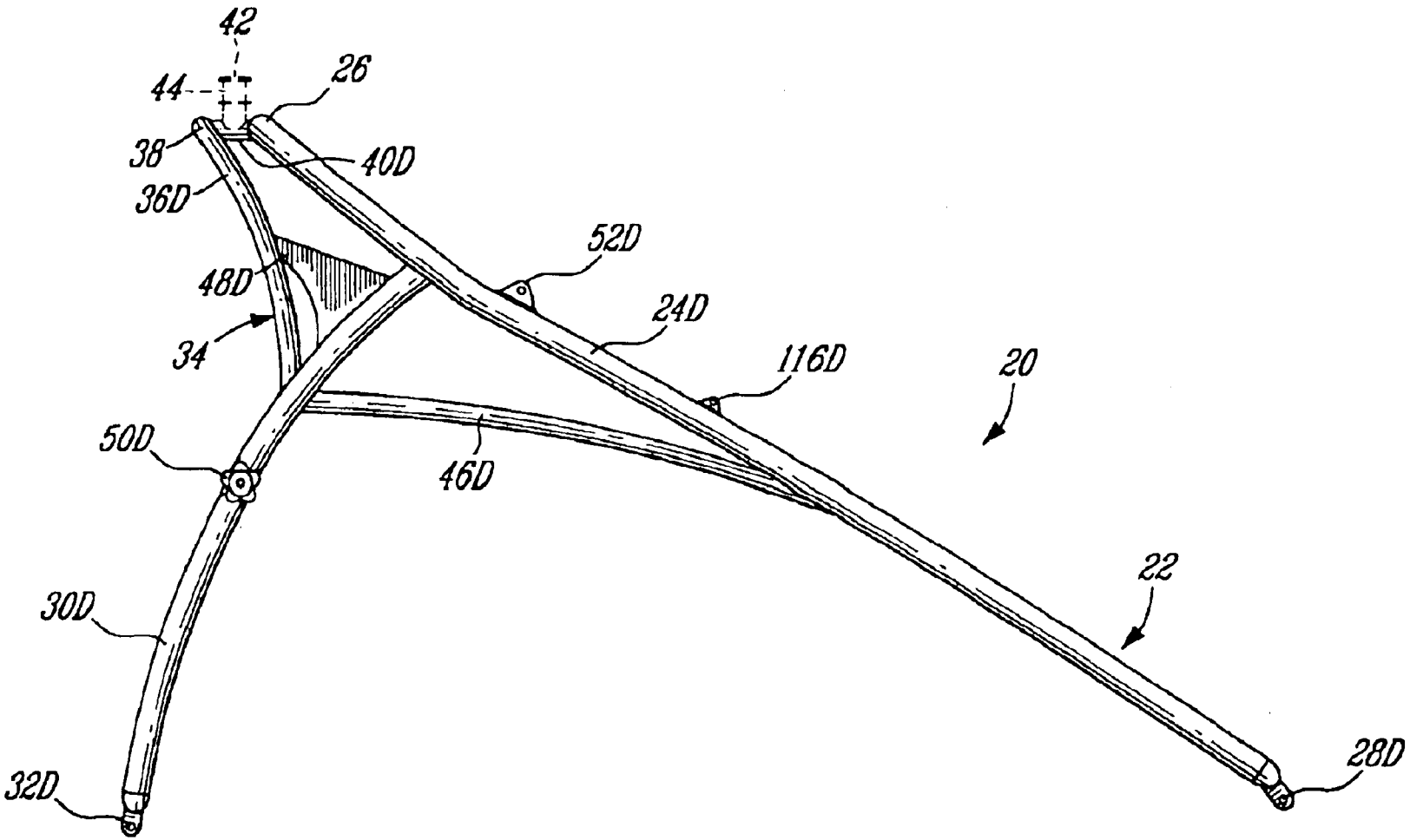
FIG. 2 is a side elevational view of the water sport tower of the present invention.

Referring to FIGS. 1 and 2, the tower 20 has a pair of support members 30, each connected to a respective one of the legs 24 of the frame member 22. Lower free ends of the support members 30 are provided with connector portions 32 (only one of which is shown in FIG. 1), so as to be releasably engaged to corresponding connector portions on the watercraft 10. The support members 30 cooperate with the frame member 22 to form a self-standing structure, having four contact points (at connector portions 28 and 32) by which it will be releasably secured to the watercraft 10.

Figure 3:
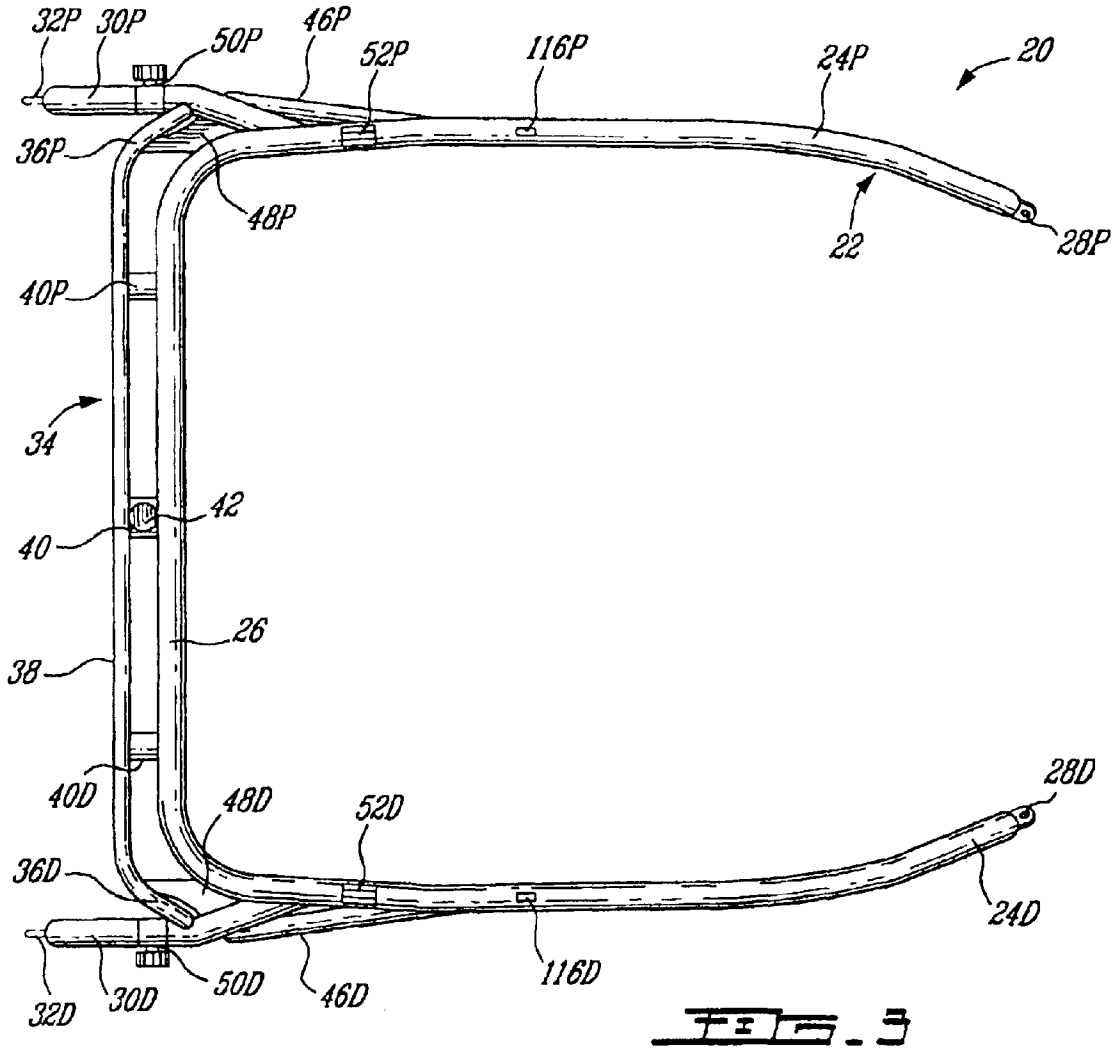
FIG. 3 is a top plan view of the water sport tower of the present invention.

A secondary frame member 34 has an inverted U-shaped body, having a pair of legs 36 interconnected by horizontal member 38. Lower free ends of the legs 36 are fixed to respective ones of the support members 30. The horizontal member 38 of the secondary frame member 34 is generally parallel to the horizontal member 26 of the main frame member 22, and spaced apart therefrom by spacers 40 (as best seen in FIG. 3). A central one of the spacers 40 supports towline connector 42. The towline connector 42 protrudes upwardly from the central spacer 40, and has a pair of flanges defining therebetween an annular groove 44 in which a connector end of a towline will be attached.

Referring to FIGS. 1 and 2, support struts 46 interconnect the legs 24 of the frame member 22 and the support members 30, whereas support plates 48 interconnect the support members 30 with the legs 36 of the secondary frame member 34 and/or with the legs 24 of the frame member 22. The support struts 46 and support plates 48 strengthen the tower 20. The overall structural configuration of the tower 20, with the various components forming a horizontal structural member (e.g., the horizontal members 26 and 38, etc.) and a vertical structural member (e.g., the legs 24, the support members 30, etc.), ensures that the tower 20 will remain rigid through any force exerted thereon by the performer. It should be noted that other structural configurations of tower 20 are possible without deviating from the scope of the invention. For example, support plates 48 could be replaced by support struts, or the tower 20 could be made of a fore frame member and an aft frame member, each having an inverted U-shaped body, with support struts between the two frame members.

The tower 20 is optionally provided with additional features. For instance, the support members 30 may be detached from legs 24, as shown by connector 50 of FIG. 2, so as to reduce the height of the tower 20 when not in use thus preventing to have to completely remove the tower 20 from the watercraft 10. The connector portions 28 and 32 are preferably part of quick-release connectors that will facilitate the removal or the installation of the tower 20 on the watercraft 10. Other features may be added, as long as the tower 20 can withstand the forces exerted by the performer being towed.

According to the present invention and as shown in FIGS. 1 to 3, pivot brackets 52 are provided on each of the legs 24, and are positioned slightly below the junction of the support members 30 with the legs 24. The pivot brackets 52 consist of pairs of spaced apart plates having bores in register so as to receive a pivot.

Figure 4:
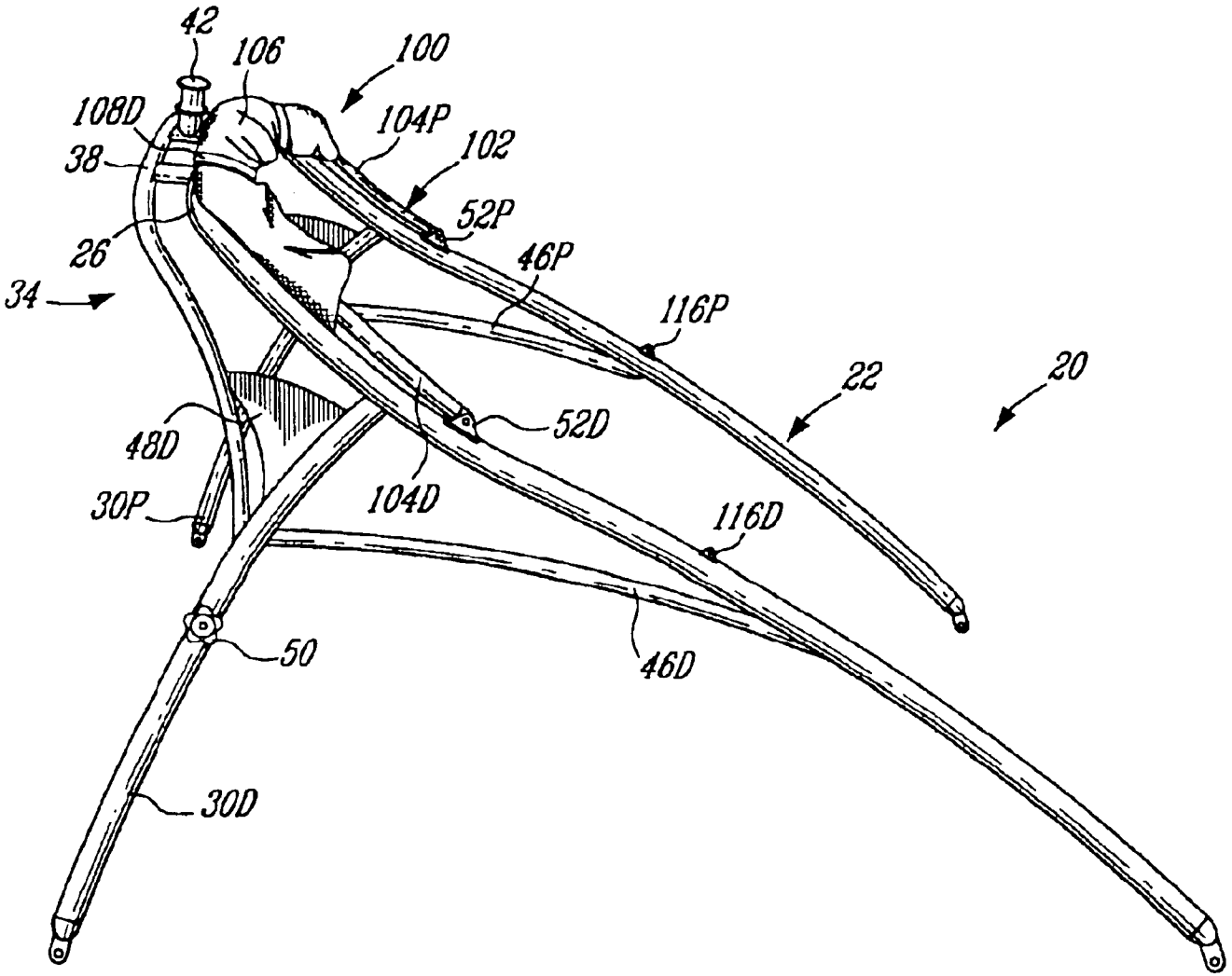
FIG. 4 is a perspective view of the water sport tower combined with a retractable top in accordance with the present invention and shown in a retracted position thereof.
Figure 5:
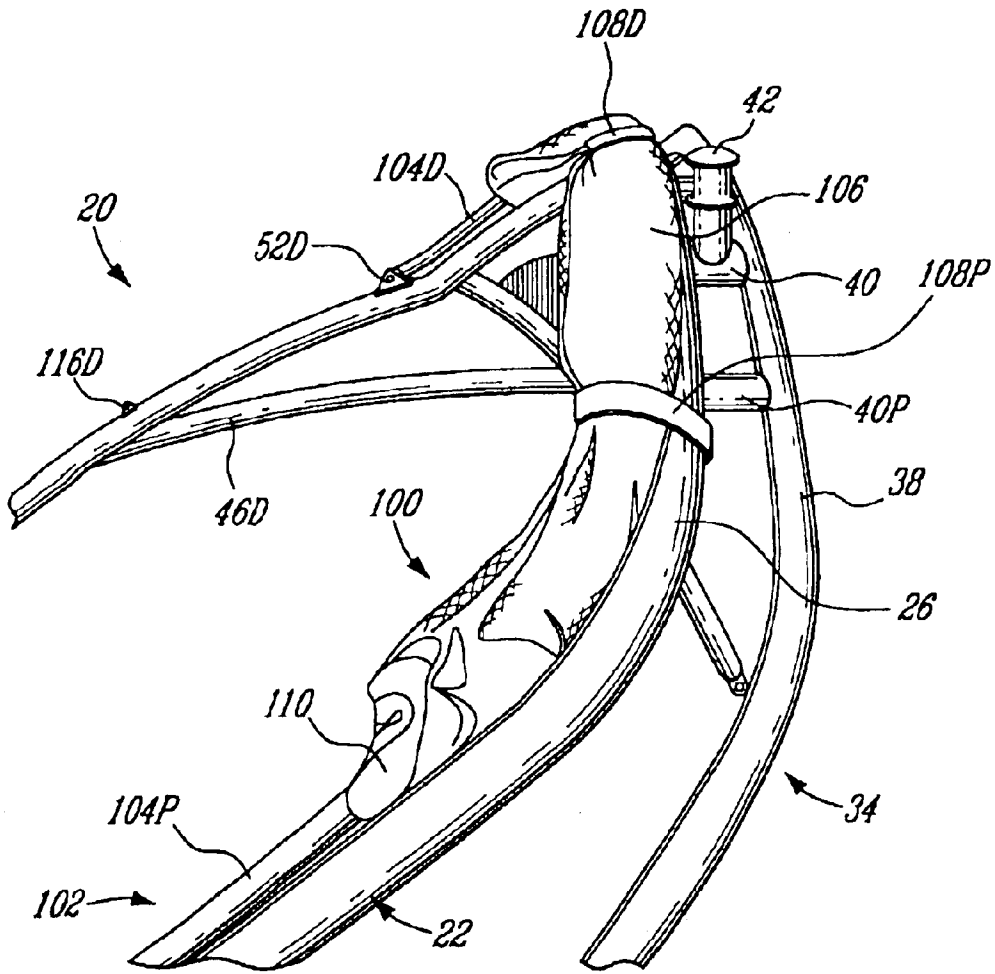
FIG. 5 is an enlarged perspective view of the retractable top in the retracted position with respect to the water sport tower.

Referring to FIGS. 4 and 5, a retractable top is generally shown at 100. The retractable top 100 has an inverted U-shaped member 102, which represents a top structural member. The U-shaped member 102 has legs 104, which are pivotally connected to the respective pivot brackets 52, such that the retractable top can pivot about the pivot brackets 52. In a retracted position thereof, the retractable top 100 has the member 102 superposed with the main frame member 22. A soft (i.e., flexible) panel, not yet visible in FIGS. 4 and 5, as it is optionally concealed in envelope 106, is wrapped around a horizontal portion of the U-shaped member 102. The envelope 106 has straps 108, preferably made of Velcro™, by which the U-shaped member 102 is securable to the main frame member 22 in the retracted position. The retractable top 100 is kept in the retracted position, for instance, when passengers of the watercraft 10 want to be exposed to the sun, or when the tower 20 is removed from the watercraft 10 and stored away. The straps 108 are preferably an integral part of the envelope 106.

The straps 108 are detached to allow the retractable top 100 to be pivoted away from the main frame member 22. This is illustrated in FIG. 6, wherein the straps 108 hang loosely, and the member 102 is away from the retracted position. In this position, the envelope 106 can be removed to uncover the panel that is concealed thereby.

Figure 8:
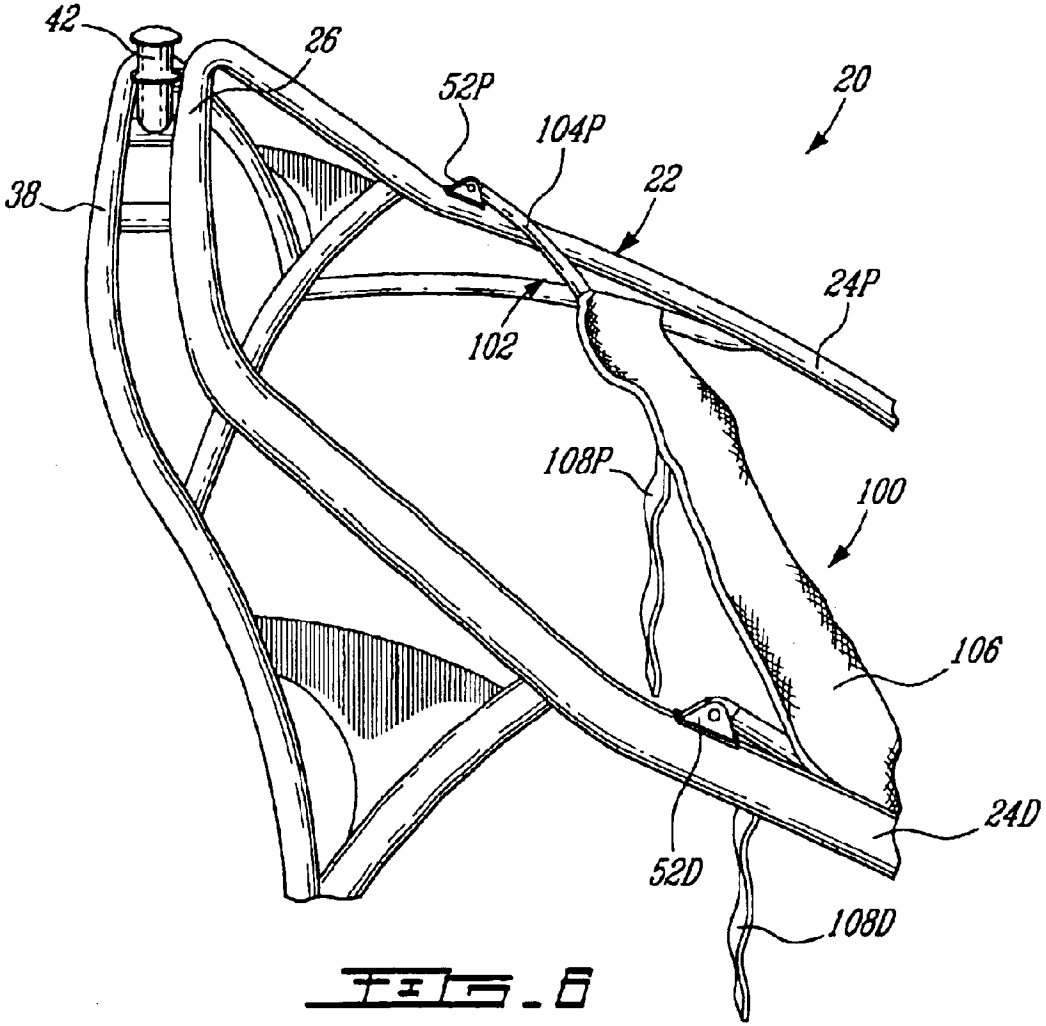
FIG. 8 is an enlarged perspective view of an aft end of the retractable top in its extended covering position.
Figure 7:
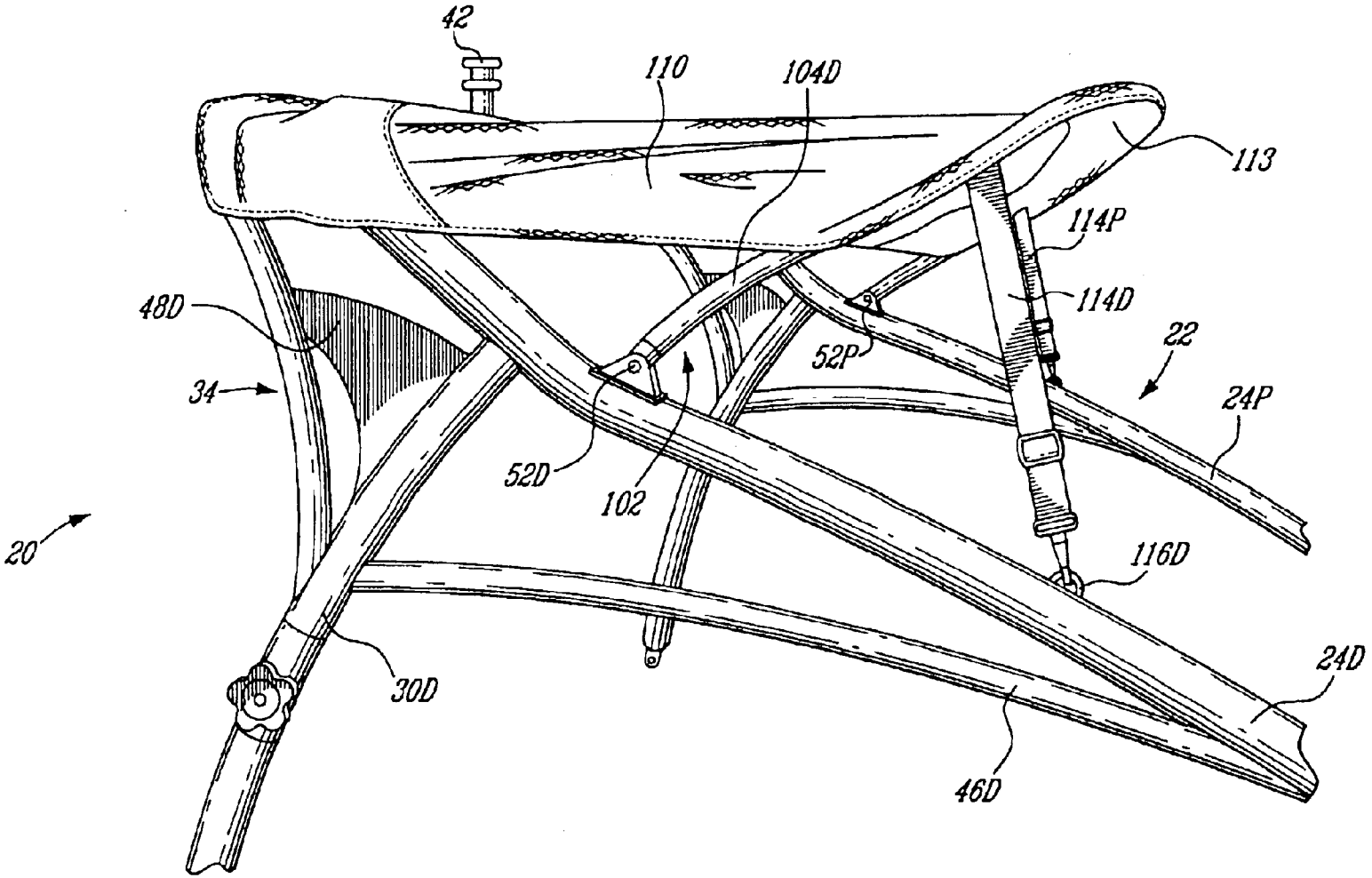
FIG. 7 is an enlarged perspective view of the retractable top in an extended covering position with respect to the water sport tower.
Figure 8:
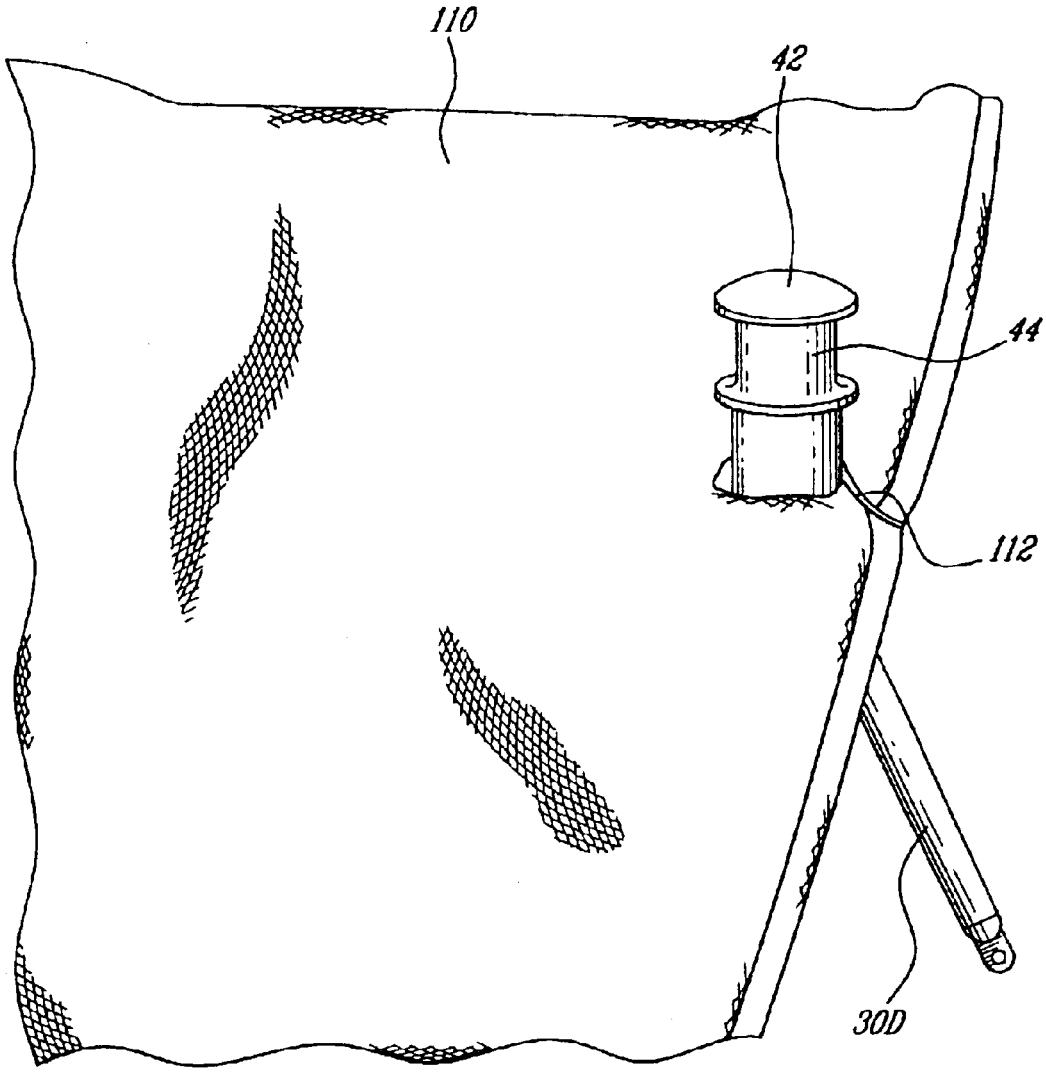
Figure 9:
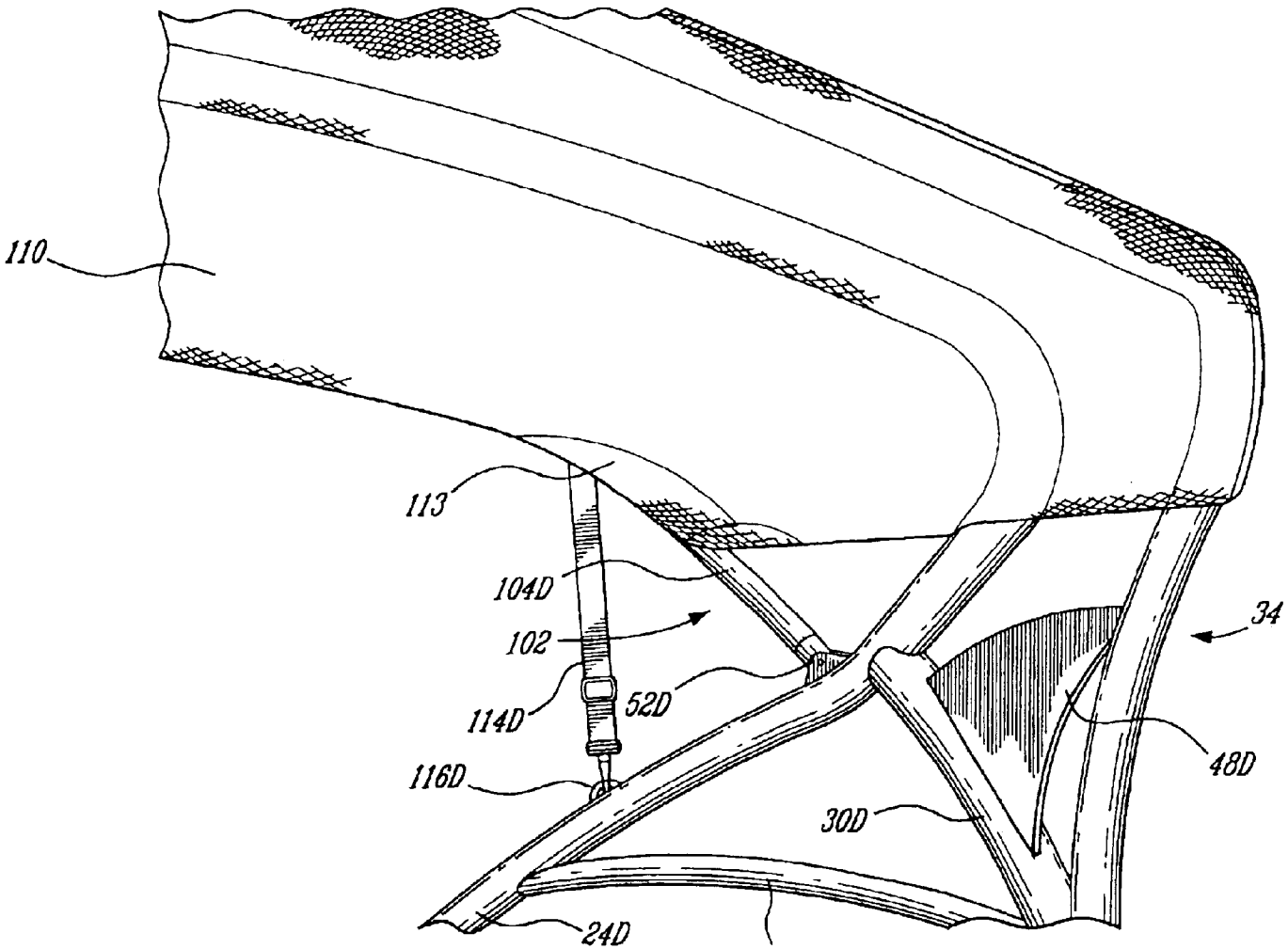
FIG. 9 is a perspective view showing part of an underside of the retractable top in the covering position with respect to the water sport tower.

Referring to FIG. 7, the soft panel is generally shown at 110 in a covering position of the retractable top 100. In this position, the soft panel 110 is stretched between the member 102 and the secondary frame member 34. As shown in FIG. 8, a slit 112 is provided in the soft panel 110, such that the towline connector 42 can pass therethrough. This enables the soft panel 110 to be wrapped around the horizontal members 26 and 38 of the main frame member 22 and the secondary frame member 34, respectively, as shown in FIG. 9. The soft panel 110 has suitable connection means such that the aft end thereof can be rigidly secured to the horizontal members 26 and 38. More precisely, once the soft panel 110 conceals the horizontal members 26 and 38, its aft end is attached to its bottom face. Various systems can be used for securing the free aft end of the soft panel 110 to the bottom face thereof in the manner shown in FIG. 9, such as snap-fasteners preferably made of stainless steel, a zipper line, etc. On the other hand, the fore end of the soft panel 110 permanently defines a tubular portion 113, into which the member 102 has been slipped into, before being connected to the main frame member 22.

Once the aft end of the soft panel 110 is secured to the horizontal members 26 and 38, the soft panel 110 is tensioned, by way of tensors 114 (FIG. 7) biasing the U-shaped member away from the horizontal member 26 of the main frame member 22. The tensors 114, or other suitable biasing means, must provide suitable tension such that the soft panel 110 remains stretched irrespective of the air resistance when the watercraft 10 is operated. As shown in FIG. 7, the tensors 114 may be adjusted in length so as to modify the amount of tension they will exert on the soft panel 110. The tensors 114 are hooked to loops 116 on the legs 24 of the main frame member 22, and are preferably sewn to the soft panel 110. Other mechanisms could be used to stretch the soft panel 110. For instance, locking devices or other similar mechanisms may be provided at the pivot between the U-shaped member 102 and the main frame member 22. Such mechanisms have the advantage of being discrete, as visible from FIG. 11, where the soft panel 110 is tensioned without visible tensors.

To cover the passenger area 16 with the retractable top 100, the following steps are taken. Firstly, the retractable top 100 is displaced from its retracted position illustrated in FIGS. 4 and 5. More precisely, the retractable top 100 is pivoted away from horizontal member 26, so as to be separated therefrom, as illustrated in FIG. 6. In the preferred embodiment, the straps 108 of the envelope 106 must be undone.

The soft panel 110, rolled on the U-shaped member 102, must be unwrapped therefrom. In the preferred embodiment, the soft panel 110 is concealed in the envelope 106, which must be removed.

The soft panel 110 is then secured to the horizontal members 26 and/or 38. In the preferred embodiment, the aft end of the soft panel 110 surrounds both the horizontal members 26 and 38, to then be secured to a bottom face thereof, by suitable connection means, as best shown in FIG. 9. In order to do so, the slit 112 defined in the soft panel 110 accommodates the towline connector 42, as best shown in FIGS. 8 and 10.

Figure 10:
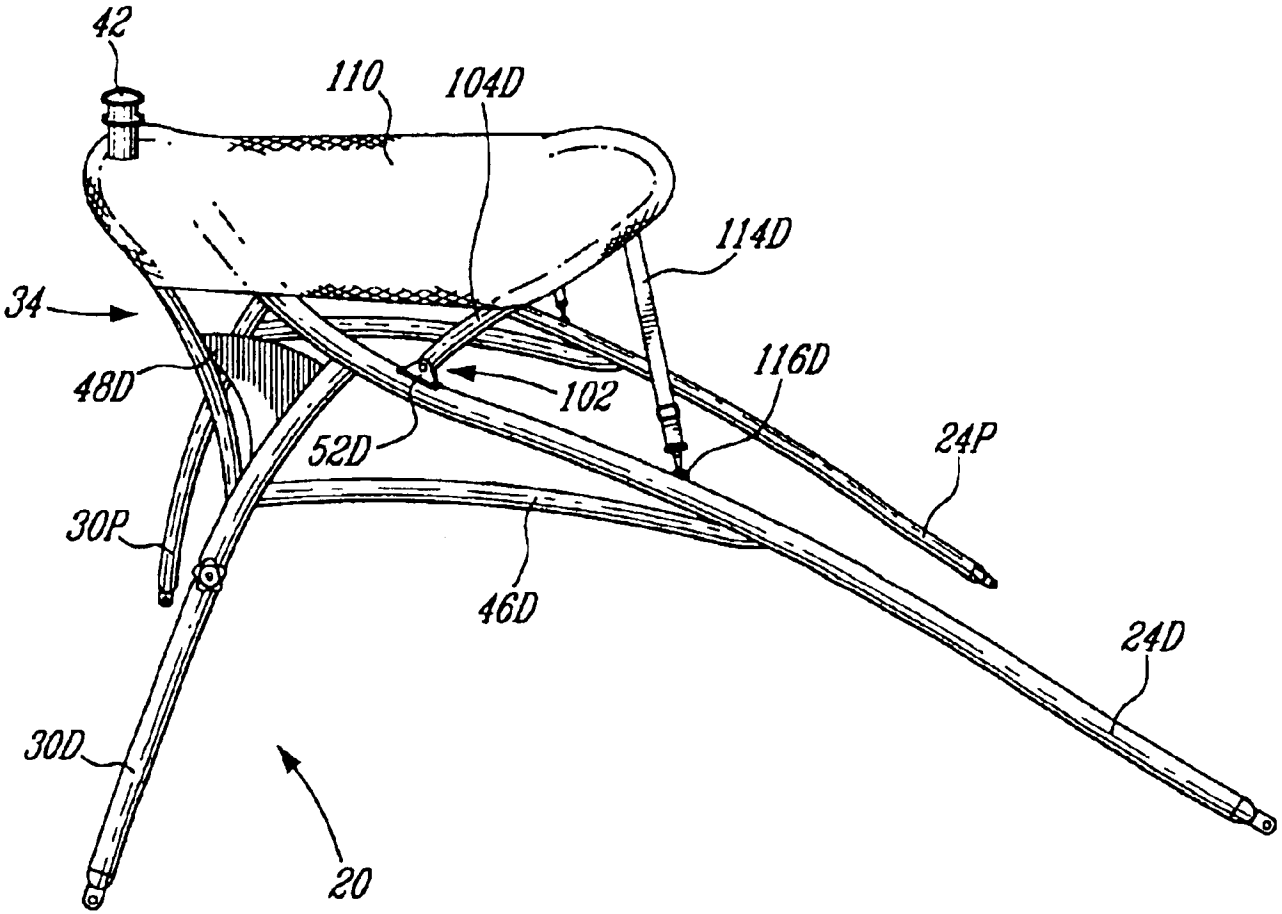
FIG. 10 is a perspective view of the water sport tower and top combination in accordance with the present invention.
Figure 11:
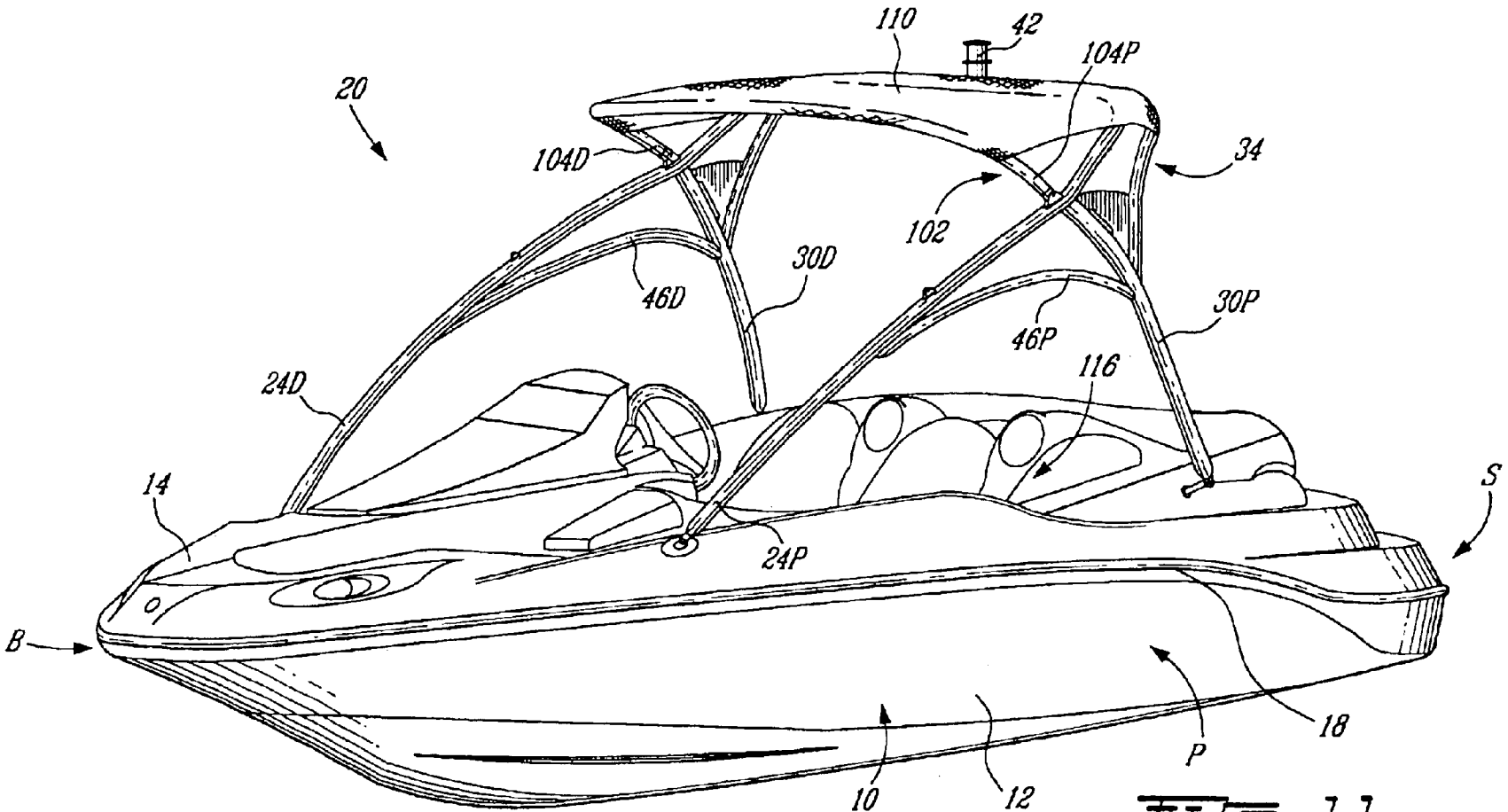
FIG. 11 is a perspective view of the water sport tower and top combination of the present invention mounted to a watercraft.

The soft panel 110 is then tensioned, so as to have the stretched shape illustrated in FIGS. 10 and 11. In the preferred embodiment, the tensors 114 are connected to the loops 116 to bias the U-shaped member 102 of the retractable top 100 away from the horizontal members 26 and 38.

The soft panel 110 may be any type of fabric or polymer offering the various following characteristics: a suitable rigidity to keep its integrity irrelevant of the air resistance, resistance to the sunlight and to the UV rays (e.g., the soft panel must not prematurely change colors under sun exposure), impermeability, etc. Moreover, although preferable, the panel 110 does not need to be flexible. The main advantage of the soft panel 110 is that it may be wrapped around the U-shaped member 102 when the retractable top 100 is in its retracted position, and does not require additional storage space. It is also advantageous that the top 100 be retractable, as passengers of the watercraft 10 may selectively cover the passenger area 16 with the top to provided a shaded area, or to get protection from rain.

The present invention uses the horizontal structural member (i.e., the horizontal members 26 and 38 and spacers 40 supporting the towline connector 42) of the water sport tower 20 as support for the top 100. Accordingly, the retractable top 100 will not create the sensation of confinement typical of tops connected below the horizontal structural member.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

We claim:

1. A water sport tower suitable for connection to a watercraft, the tower comprising:

a support structure having an inverted generally U-shaped configuration, the structure, comprising a pair of side supports and an overhead structure extending between the side supports, the overhead structure comprising first and second substructures;

a towline connector for receiving an end of a towline being provided on the first substructure; and a protective cover extending between the first and second substructures, the protactive cover having an opening through which the towline connector extends.

2. The tower according to claim 1, wherein the protective cover is a soft panel covering at least a portion of the first substructure.

3. The tower according to claim 2, wherein a first end of the soft panel surrounds at least a portion of the first substructure so as to secure the soft panel thereto.

4. The tower according to claim 3, wherein the first end of the soft panel is releasably secured to a bottom face of the soft panel.

5. The tower according to claim 1, wherein when attached to the watercraft the first substructure is an aft substructure, and the second substructure is a fore substructure.

6. The tower according to claim 3, wherein a second end of the cover has a tubular portion surrounding at least a portion of the second substructure.

7. The tower according to claim 1, wherein the support structure is adapted to be releasably mounted to a watercraft.

8. The tower according to claim 1, incorporated into a watercraft.

9. A water sport tower suitable for connection to a watercraft, the tower comprising:

a support structure having an inverted generally U-shaped configuration, the structure comprising a pair of side supports and an overhead structure extending between the side supports, the overhead structure comprising first and second substructures;

a towline connector for receiving an end of a towline being provided on the first substructure; and a protective cover extending between the first and second substructures, the second substructure is pivotable between a retracted position wherein the second substructure is generally superposed with the first substructure, and a covering position wherein the second substructure is spaced apart from the first substructure.

10. The tower according to claim 9, wherein the cover is detachable from the first substructure and is capable of be wrapped around the second substructure in the retracted position thereof.

11. The tower according to claim 10, further comprising a removable envelope for concealing the cover wrapped around the second substructure in the retracted position thereof.

12. The tower according to claim 11, wherein the removable envelope has at least one strap for securing the second substructure to the first substructure in the retracted position of the second substructure.

13. The tower according to claim 9, incorporated into a watercraft.

14. A method for covering a passenger area of a watercraft having a water sport tower, the water sport tower having an inverted generally U-shaped configuration and comprising a pair of side supports, and an overhead structure extending between the side supports and having a towline connector thereon adapted to receive an end of a towline, the method comprising the steps of:

i) providing the tower with a structural member in a spaced and parallel position with respect to the overhead structure;

ii) securing a first end of a cover to the structural member;

iii) securing a second end of the cover to the overhead structure; and iv) tensioning the cover by biasing the structural member away from the overhead structure.

15. The method according to claim 14, further comprising the step of unwrapping the cover from a rolled configuration about the structural member prior to the step of securing the second end of the cover to the overhead structure.

16. The method according to claim 15, further comprising the step of removing an envelope concealing the cover in the rolled configuration prior to the step of unwrapping the cover.

17. The method according to claim 14, further comprising the step of positioning the towline connector through an opening defined in the cover.

18. The method according to claim 14, further comprising the step of surrounding the overhead structure with the second end of the cover and the step of securing the second end of the cover to a bottom face of the cover.

19. The method according to claim 14, wherein the step of providing a structural member in a spaced and parallel position with respect to the overhead structure comprises the step of positioning the structural member forwardly of the overhead structure.

* * * * *